US008124222B2

(12) United States Patent
Myrtveit

(10) Patent No.: US 8,124,222 B2
(45) Date of Patent: Feb. 28, 2012

(54) COATED CUTTING TOOL AND METHOD OF MAKING A COATED CUTTING TOOL

(75) Inventor: Toril Myrtveit, Kungsängen (SE)

(73) Assignee: Sandvik Intellectual Property AB, Sandviken (SE)

( * ) Notice: Subject to any disclaimer, the term of this patent is extended or adjusted under 35 U.S.C. 154(b) by 344 days.

(21) Appl. No.: 12/336,157

(22) Filed: Dec. 16, 2008

(65) Prior Publication Data

US 2009/0162153 A1 Jun. 25, 2009

(30) Foreign Application Priority Data

Dec. 21, 2007 (SE) ..... 0702866
Mar. 19, 2008 (SE) ..... 0800634

(51) Int. Cl.
*B32B 9/00* (2006.01)

(52) U.S. Cl. ..... 428/216; 51/307; 51/309; 204/192.1; 204/192.15; 204/192.16; 427/419.1; 427/419.2; 427/419.7; 428/336; 428/469; 428/472; 428/697; 428/698; 428/699; 428/701; 428/702

(58) Field of Classification Search ..... 51/307, 51/309; 428/216, 336, 469, 472, 697, 698, 428/699, 701, 702; 204/192.1, 192.15, 192.16; 427/419.1, 419.2, 419.7
See application file for complete search history.

(56) References Cited

U.S. PATENT DOCUMENTS 4,643,951 A * 2/1987 Keem et al. ..... 428/472
4,904,542 A * 2/1990 Mroczkowski ..... 428/698
5,656,364 A * 8/1997 Rickerby et al. ..... 428/216
(Continued)

FOREIGN PATENT DOCUMENTS

EP 0 289 173 11/1988
(Continued)

OTHER PUBLICATIONS

European Search Report Action mailed Aug. 3, 2010 issued in European Application No. 08 17 1440.4.
Gunnars J et al: "Thermal stresses in diamond coatings and their influence on coating wear and failure" Surface and Coatings Technology 1996, vol. 80, No. 3, Elsevier Science S.A., Apr. 1996, pp. 303-312.

*Primary Examiner* — Archene Turner
(74) *Attorney, Agent, or Firm* — Morgan, Lewis & Bockius LLP

(57) ABSTRACT

The invention relates to a coated cutting tool comprising a substrate provided with a coating comprising a metallic interlayer placed in-between at least two non-metallic, functional layers or layer systems where the metallic interlayer comprises at least 60 at % metal elements chosen from one or more of Ti, Mo, Al, Cr, V, Y, Nb, W, Ta and Zr, or mixtures thereof, and wherein the at least two non-metallic, functional layers or layer systems is one or more of nitrides, oxides, borides, carbides, or combinations thereof, and wherein the thickness of the at least two non-metallic functional layer or layer systems is from about 3 to about 200 times the thickness of the metallic interlayer. The number of non-metallic, functional layers or layer systems alternated with metallic interlayers is at least 3.
The invention also relates to a method of making a cutting tool according to the invention.
Cutting tools according to the invention have an increased tool life.

11 Claims, 1 Drawing Sheet

U.S. PATENT DOCUMENTS

| | | | | | |
|---|---|---|---|---|---|
| 5,948,548 | A | * | 9/1999 | Welty et al. | 428/623 |
| 5,952,085 | A | * | 9/1999 | Rickerby et al. | 428/336 |
| 6,143,424 | A | * | 11/2000 | Jonte et al. | 428/623 |
| 6,489,036 | B1 | * | 12/2002 | Sherman | 428/469 |
| 6,617,057 | B2 | * | 9/2003 | Gorokhovsky et al. | 428/698 |
| 7,186,092 | B2 | * | 3/2007 | Bruce et al. | 416/241 R |
| 7,581,933 | B2 | * | 9/2009 | Bruce et al. | 416/241 R |
| 2002/0102400 | A1 | | 8/2002 | Gorokhovsky et al. | |

FOREIGN PATENT DOCUMENTS

| | | | |
|---|---|---|---|
| EP | 1 676 939 | | 7/2006 |
| GB | 2 170 226 | | 7/1986 |
| GB | 2 303 380 | * | 2/1997 |
| JP | 2002-103122 | * | 4/2002 |

* cited by examiner

COATED CUTTING TOOL AND METHOD OF MAKING A COATED CUTTING TOOL

CROSS-REFERENCE TO PRIOR APPLICATION

This application claims priority to Sweden Application No. SE 0702866-5 filed Dec. 21, 2007 and Sweden Application No. SE 0800634-8 filed Mar. 19, 2008, which is incorporated by reference herein.

BACKGROUND OF THE INVENTION

The present invention relates to a coated cutting tool comprising one or more metallic interlayers in-between two non-metallic, functional layers or layer systems. The cutting tools according to the present invention will exhibit superior life time due to an increased toughness, thus showing better ability to withstand changes in load. In addition, this invention facilitates deposition of thicker PVD-coatings without the risk of spalling along the edge line, hence thicker coatings with better flank wear resistance can be deposited. The tougher behavior of the coatings facilitates reasonably thick coatings even on sharp or ground edges.

In general, the life time of a cutting tool is significantly prolonged if a coating is deposited onto its surface. Most cutting tools today are coated with PVD or CVD coatings like Ti(C,N), TiN, (Ti,Al)N, (Ti,Si)N, (Al,Cr)N or $Al_2O_3$. PVD coatings have several attractive properties compared to CVD coatings, for instance, finer grained coatings and compressive stresses in the as-deposited state, which gives a better ability to tolerate changes in load. However, PVD coatings usually have to be quite thin, since thicker PVD coatings may cause spalling, frittering, so-called edge-line spalling and flaking, either spontaneously, usually around the edge line, or during machining.

The maximum coating thickness that can be deposited on a tool before spalling occurs depend on the edge radius, ER. Sharp edges with small ER, and ground edges are particularly prone to spalling and flaking along the edge line, and thus thin coatings are usually deposited. However, slightly thicker coatings would be preferred if the edge line could be kept intact since thicker coatings in most cases would lead to an increased tool life due to better wear resistance.

Deposition of metallic layers with PVD techniques is an established technology in PVD-processes. It is well-known that depositing a metallic layer directly onto the surface of the substrate before depositing the rest of the coating can enhance the adhesion of the coating.

A few attempts have also been made to deposit metallic layers between non-metallic layers.

US2002/0102400 A describes a wear resistant coating comprising alternating metallic and ceramic layers. The coating will have a fine grained surface with low micro-roughness. The coating is preferably deposited onto substrates of steel, titanium, or carbide e.g. TiC, but preferably steel. The substrates are preferably in the form of a dental tool, surgical tool or cutting tool. In the examples, dental scalers of steel are provided with the coating.

OBJECTS AND SUMMARY OF THE INVENTION

It is an object of the present invention to provide a coated cutting tool having a PVD-coating not being prone to spalling, frittering, so-called edge-line spalling and flaking, not even on sharp geometries and ground edges, thus obtaining a tool with an increased tool life.

It is an object of the present invention to provide a coated cutting tool having a sharp uncoated edge radius, ER, and a thick PVD coating without the risk of edge-line spalling, frittering, flaking etc., thus obtaining a tool with an increased tool life.

It is another object of the present invention to provide a coated cutting tool having improved flank wear resistance.

It is another object of the present invention to provide a method of making coated cutting tools having the benefits disclosed above.

In one aspect of the invention, there is provided a coated cutting tool comprising a substrate of cemented carbide, cermets, ceramics, cubic boron-nitride or high speed steel provided with a coating comprising a metallic interlayer placed in-between at least two non-metallic, functional layers or layer systems where the metallic interlayer comprises at least about 60 at % metal elements chosen from one or more of Ti, Mo, Al, Cr, V, Y, Nb, W, Ta and Zr, and where the at least two non-metallic, functional layers or layer systems is one or more of nitrides, oxides, borides, carbides, or combinations thereof, the thickness of the at least two non-metallic functional layer or layer systems being from about 3 to about 200 times the thickness of the metallic interlayer and the number of non-metallic, functional layers or layer systems alternated with metallic interlayers is at least 3.

In another aspect of the invention, there is provided a method of making a coated cutting tool having a substrate of cemented carbide, cermets, ceramics, cubic boron-nitride or high speed steel, and coating said substrate with a coating process comprising the steps of: a). deposition of at least one non-metallic, functional layer or layer system, comprising nitrides, oxides, borides, carbides, or combinations thereof; b). deposition of at least one metallic interlayer, comprising at least about 60 at % metal elements chosen from one or more of Ti, Mo, Al, Cr, V, Y, Nb, W, Ta and Zr; c). onto said metallic interlayer, depositing of at least one non-metallic, functional layer or layer system comprising nitrides, oxides, borides, carbides, or combinations thereof; wherein steps b) and c), are repeated at least 1 time, the thickness of the non-metallic functional layer or layer systems is from about 3 to about 200 times the thickness of the metallic interlayer and the number of non-metallic, functional layers or layer systems alternated with metallic interlayers is at least 3.

DETAILED DESCRIPTION OF THE PREFERRED EMBODIMENTS

Figure 1:
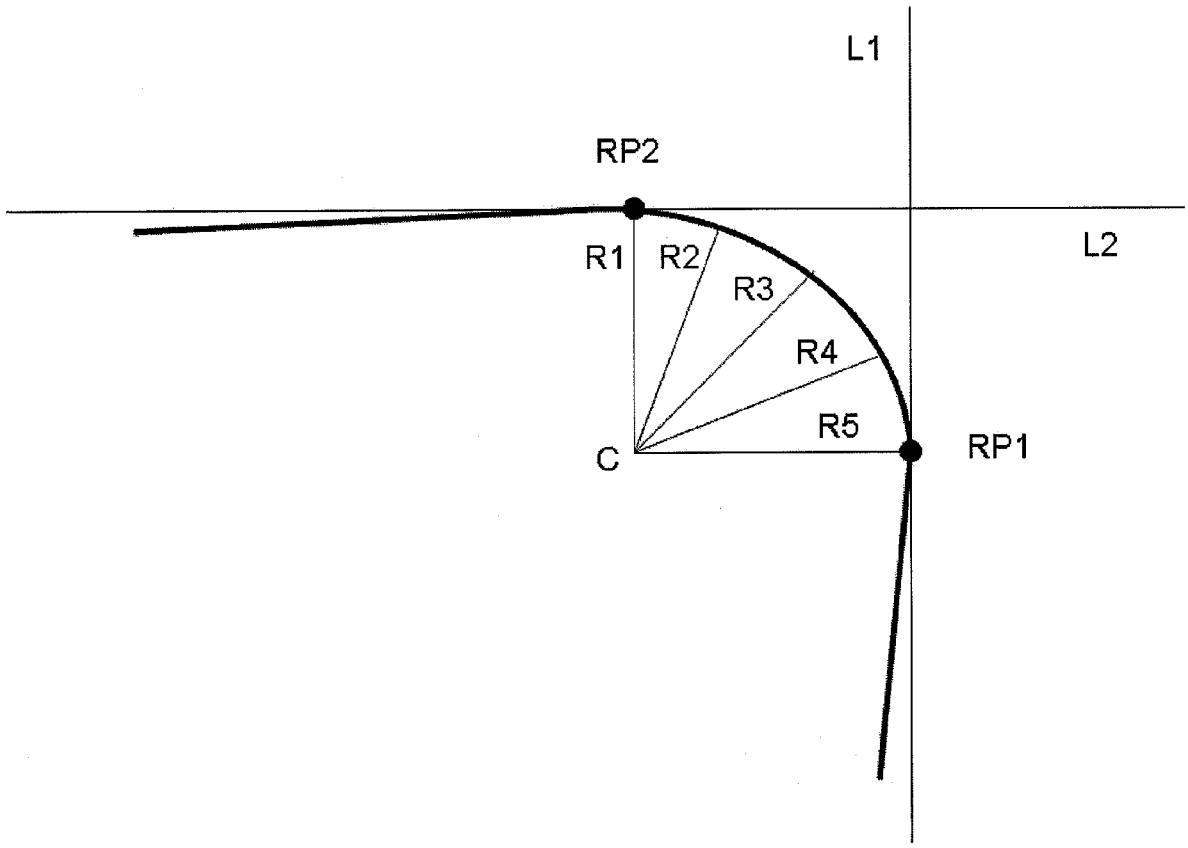
FIG. 1 shows a polished cross-section of the edge of an insert. Two lines being respectively parallel and normal to the support face are drawn. From these two lines, two reference points are found, from which we further find the center. ER is now defined as the average distance at five different angles from the center to the edge.

It has surprisingly been found that by providing a coated cutting tool comprising a metallic interlayer placed in-between two non-metallic, functional layers or layer systems, the objects above can be fulfilled.

The present invention relates to a coated cutting tool comprising a substrate of cemented carbide, cermets, ceramics, cubic boron-nitride or high speed steel provided with a coating comprising a metallic interlayer placed in-between at least two non-metallic, functional layers or layer systems, where the metallic interlayer comprises at least about 60 at % metal elements chosen from one or more of Ti, Mo, Al, Cr, V, Y, Nb, W, Ta and Zr, and where the at least two non-metallic, functional layers or layer systems is one or more of nitrides, oxides, borides, carbides, or combinations thereof.

The thickness of the at least two non-metallic functional layers or layer systems is from about 3 to about 200 times the thickness of the metallic interlayer. The number of non-metallic, functional layers or layer systems alternated with metallic interlayers is at least about 3, preferably between from about 3 and to about 20, more preferably between from about 3 and to about 15, and most preferably between from about 3 to about 8, non-metallic, functional layers or layer systems.

By metallic interlayer is herein meant a layer comprising at least about 60 at %, preferably at least 70 at %, more preferably at least about 80 at % and most preferably at least about 90 at % metal elements chosen from one or more of Ti, Mo, Al, Cr, V, Y, Nb, W, Ta and Zr.

The metallic interlayers can also comprise small amounts of other elements but then at a level corresponding to a technical impurity thus not significantly affecting the ductility of the layers.

In one embodiment of the present invention, the metallic interlayer is a pure metal layer where the metal(s) are chosen from Ti, Mo, Al, Cr, V, Y, Nb, W, Ta and Zr, preferably Ti, Mo, Cr, Al, V, Ta and Zr, most preferably Ti, Al, Zr and Cr, or mixtures thereof, where one of these elements constitute at least about 50 at % of the pure metal layer.

In another embodiment of the present invention, the metallic interlayer is a substoichiometric ceramic, preferably a nitride, oxide, carbide or boride, more preferably a nitride MeN, where Me is a metal that can be one or more of the metals included in the case of a pure metal interlayer as described above. The amount of the metal element is at least about 60 at %, preferably at least 70 at %, more preferably at least about 80 at % and most preferably at least about 90 at %, of the substoichiometric ceramic.

The average thickness of the metallic interlayers can be from about 5 to about 500 nm, preferably from about 10 to about 200 nm, and most preferably from about 20 to about 70 nm.

All thicknesses given herein refer to measurements conducted on a reasonably flat surface being in direct line of sight from the targets. For inserts mounted on a stick during deposition, it means that the thickness has been measured on the middle of the flank side. For irregular surfaces, such as those on e.g. drills and end mills, the thicknesses given herein refers to the thickness measured on any reasonably flat surface or a surface having a relatively large curvature and some distance away from any edge or corner. For instance, on a drill, the measurements have been performed on the periphery and on an end mill the measurements have been performed on the flank side.

The non-metallic functional layers or layer systems can have any composition suitable for cutting tools, such as nitrides, oxides, borides, carbides, or combinations thereof. Preferably, the coating comprises one or more layers of one or more of (Al,Ti)N, TiN, (Al,Cr)N, CrN, ZrN, Ti(B,N), $TiB_2$, (Zr,Al)N, (Ti,X)N, oxides of one or more of Al, Zr and Cr, more preferably (Al,Ti)N, Ti(B,N), (Ti,X)N, where X can be one or more of Si, Ta, V, Y, Cr, Nb and Zr, and most preferably (Al,Ti)N.

The non-metallic, functional layers or layer systems according to the present invention can have any coating structure common in the art of coating cutting tools.

The at least two layers or layer systems, in-between which the metallic interlayer is placed, can be the same or different from each other with regard to structure and composition. By layer system is herein meant at least two layers which are deposited on top of each other without any metallic interlayer in-between. One example of such a layer system is a multilayered structure comprising at least 5 individual layers. However, such a multilayered structure can comprise up to several thousands of individual layers.

The average thickness of the non-metallic, functional layers or layer systems can be from about 0.3 to about 5 μm, preferably from about 0.3 to about 2 μm, most preferably from about 0.4 to about 1.5 μm.

The non-metallic layers or layer systems are significantly thicker than the metallic interlayers, the thickness of the non-metallic layers or layer systems is preferably from about 3 to about 200 times the thickness of the metallic interlayers, more preferably from about 5 to about 150 times thicker, most preferably from about 10 to about 100 times thicker.

The thickness of the whole coating comprising both metallic and non-metallic layers or layer systems can be from about 0.6 to about 15 μm, preferably from about 1 to about 10 μm and most preferably from about 2 to about 9 μm.

Substrates suitable for the present invention are preferably cutting tool inserts, or round tools such as drills, end mills etc. The substrate is preferably made of any one of cemented carbide, cermets, ceramics, cubic boronitride or high speed steels, more preferably cemented carbide. By cemented carbide is herein meant a substrate comprising mainly tungsten carbide and cobalt as binder phase. The substrates can be pre-coated with an inner layer directly onto the substrate to ensure a good adhesion to the substrate, the inner layer comprising a pure metal and/or a nitride, preferably Ti and/or TiN, said layer being from about 0.02 to about 0.5 μm, preferably from about 0.05 to about 0.1 μm, thick.

The edge of an insert usually displays an arc shape called the edge radius, ER. ER can be measured from a polished cross-section of an insert, being cut normal to the cutting edge. The ER is defined by drawing a line parallel to the inserts support face, and another line normal to the first. The two points, where the shape of the insert tangents or deviates from these straight lines, are called reference points (RP1 and RP2). From the two reference points, another two lines are drawn (L1 and L2), parallel to the first two lines. The intersection of the two lines going through the reference points, are called the center (C). Measuring the distance from the center to the edge at 0, 22.5, 45, 67.5 and 90 degrees (R1, R2 . . . R5) and calculating the average, gives the ER. The procedure is illustrated in FIG. 1. For the case where the edge has a land at the rake side or when the edge is ground, as it is on for instance a solid drill or an end mill, ER is defined as the radius of a circle having a center lying on the bisector between the two ground surfaces, or between the ground surface and the flank side, and fitted to the arc using the method of least squares.

In one embodiment of the present invention, the thickness of the coating is at least about 10%, preferably more than about 15%, most preferably more than about 20%, of the edge radius, ER, but less than about 45%, preferably less than about 40% and most preferably less than about 35% of the edge radius, ER.

In one embodiment of the present invention, the substrate is a cutting tool insert having an uncoated ER of less than about 35 μm and the coating thickness is from about 6 to about 11 μm.

In another embodiment of the present invention, the substrate is a cutting tool insert having an uncoated ER of less than about 20 μm and the coating thickness is from 4 to 7 m.

In another embodiment of the present invention, the substrate is a drill or end mill having an uncoated ER of less than 15 μm and the coating thickness is from about 2 to about 5 μm.

In one embodiment of the present invention, the at least two non-metallic layers or layer systems are (Ti,Al)N and have a thickness of between about 0.5 to about 2 μm, and the thin metallic interlayers are Ti with a thickness preferably between from about 20 to about 50 nm.

In one embodiment of the present invention, the metallic interlayer is an alloy of Ti and Al.

In yet another embodiment of the present invention, the metallic interlayer is an alloy of Al and Cr.

The present invention also relates to a method of making a coated cutting tool according to the above. The method comprises the steps of providing a substrate, coating said substrate with a coating process comprising the steps of:

a). deposition of at least one non-metallic, functional layer or layer system, b). deposition of at least one metallic interlayer, c). onto said metallic interlayer, deposit at least one non-metallic, functional layer or layer system, Steps b) and c), as described above are repeated at least 1 time, preferably between 1 and 14 times, more preferably between 1 and 9 times, and most preferably between 1 and 7 times, until the desired total coating thickness is achieved.

By metallic interlayer is herein meant a layer comprising at least about 60 at %, preferably at least 70 at %, more preferably at least about 80 at % and most preferably at least about 90 at % metal elements chosen from one or more of Ti, Mo, Al, Cr, V, Y, Nb, W, Ta and Zr.

The metallic interlayer is preferably deposited within the same coating sequence as the functional layers by changing the atmosphere from a reactive gas to an inert gas, e.g. He, Ar, Kr, Xe or a combination of these gases.

In one embodiment of the present invention, the metallic interlayer is a pure metal layer where the metal(s) are chosen from Ti, Mo, Al, Cr, V, Y, Nb, W, Ta and Zr, preferably Ti, Mo, Cr, Al, V, Ta and Zr, most preferably Ti, Al, Zr and Cr, or mixtures thereof, where one of these elements constitute at least about 50% of the pure metal interlayer.

In another embodiment of the present invention, the interlayer is a substoichiometric ceramic, preferably a nitride, oxide, carbide or boride, more preferably a nitride MeN, where Me is a metal that can be one or more of the metals included in the case of a pure metal interlayer as described above or mixtures thereof. The amount of the metal element is at least about 60 at %, preferably at least 70 at %, more preferably at least about 80 at % and most preferably at least about 90 at % of the substoichiometric ceramic.

The average thickness of the metallic interlayers is preferably from about 5 nm to about 500 nm, more preferably from about 10 nm to about 200 nm and most preferably from about 20 nm to about 70 nm.

The non-metallic, functional layers or layer systems deposited according to the present invention can have any composition suitable for cutting tools, such as nitrides, oxides, borides, carbides, or combinations thereof. Preferably the coating comprises one or more layers of one or more of (Al,Ti)N, TiN, (Al, Cr)N, CrN, ZrN, Ti(B,N), $TiB_2$, (Zr,Al)N, (Ti,X)N, oxides of one or more of Al, Zr and Cr, more preferably (Al,Ti)N, Ti(B,N), (Ti,X)N, where X can be one or more of Si, Ta, V, Y, Cr, Nb and Zr, and most preferably (Al,Ti)N.

The non-metallic, functional layers or layer systems deposited according to the present invention can have any coating structure common in the art of coating cutting tools. The at least two layers or layer systems, in-between which the metallic interlayer is placed, can be the same or different from each other with regard to structure and composition.

The average thickness of the non-metallic, functional layers or layer systems can be from about 0.3 to about 5 μm, preferably from about 0.3 to about 2 μm, most preferably from about 0.4 to about 1.5 μm.

The non-metallic layers or layer systems are significantly thicker than the metallic interlayers, the thickness of the non-metallic layers or layer systems is preferably from about 3 to about 200 times the thickness of the metallic interlayers, more preferably from about 5 to about 150 times thicker, most preferably from about 10 to about 100 times thicker.

The thickness of the whole coating, comprising both metallic and non-metallic layers or layer systems, can be from about 0.5 to about 15 μm, preferably from about 1 to about 10 μm and most preferably from about 2 to about 9 μm.

Substrates suitable for the present invention are preferably cutting tool inserts, or round tools such as drills, end mills etc. The substrate is preferably made of any of cemented carbide, cermets, ceramics, cubic boron-nitride or high speed steels, preferably cemented carbide. The substrate can be pre-coated with an inner layer deposited directly onto the substrate to ensure a good adhesion to the substrate, the inner layer comprising a pure metal and/or a nitride, preferably Ti and/or TiN, said layer being from about 0.02 to about 0.5 μm, preferably from about 0.05 to about 0.1 μm and is deposited within the same coating process as the rest of the layers.

In one embodiment of the present invention, the thickness of the coating is at least about 10%, preferably more than about 15%, most preferably more than about 20%, of the edge radius, ER, but less than about 45%, preferably less than about 40% and most preferably less than about 35% of the edge radius, ER.

In one embodiment of the present invention, the substrate is a cutting tool insert having an uncoated ER of less than about 35 μm and the coating thickness is from about 6 to about 11 μm.

In another embodiment of the present invention, the substrate is a cutting tool insert having an uncoated ER of less than 20 μm and the coating thickness is from about 4 to about 7 μm.

In another embodiment of the present invention, the substrate is a drill or end mill having an uncoated ER of less than about 15 μm and the coating thickness is from about 2 to about 5 μm.

Any PVD technique commonly used when coating cutting tools can be used in the method of the present invention. Preferably cathodic arc evaporation or magnetron sputtering is used, although emerging technologies such as HIPIMS (high power impulse magnetron sputtering), could also be used. Even if the coating according to the present invention is referred to as a "PVD-coating" the coating can also be deposited with for example a PECVD technique (Plasma Enhanced Chemical Vapor Deposition) which will generate coatings with properties closer to those of PVD coatings than conventional CVD coatings.

In one embodiment of the present invention, the deposited non-metallic, functional layers or layer systems are (Ti,Al)N with a thickness of between from about 0.5 and to about 2 μm and the deposited thin metallic interlayers are Ti with a thickness preferably between from about 20 and to about 70 nm.

In another embodiment of the present invention, the metallic interlayer is an alloy of Ti and Al.

In yet another embodiment of the present invention, the metallic interlayer is an alloy of Al and Cr.

The invention is additionally illustrated in connection with the following examples, which are to be considered as illustrative of the present invention. It should be understood, however, that the invention is not limited to the specific details of the examples.

EXAMPLE 1

Cemented carbide milling inserts with two different geometries, R290-12T308M-KM and R390-11T0308M-PM were used, wherein inserts A were coated in accordance with prior art, with a 6 μm, as measured on the flank side, thick homogenous $Ti_{0.33}Al_{0.67}N$ coating. The coating was deposited by cathodic arc evaporation in an $N_2$-atmosphere and the inserts were mounted on a 3-fold rotating substrate table. The (Ti, Al)N-coating was deposited from two pairs of $Ti_{0.33}Al_{0.67}$-targets.

Insert B was coated according to the present invention. The same deposition conditions as for insert A were applied except that, after having deposited a $Ti_{0.33}Al_{0.67}N$-layer with a certain thickness, the deposition was stopped, and the reactor chamber was filled with Ar and one pair of Ti-targets were ignited and a thin, approximately 30 nm, metallic Ti layer was deposited. Then the reactor was filled with $N_2$-gas and a new $Ti_{0.33}Al_{0.67}N$-layer was deposited. These steps of depositing the Ti layer and the $Ti_{0.33}Al_{0.67}N$-layer were repeated 7 times until a total coating thickness of 6 μm was achieved. The average thickness of the $Ti_{0.33}Al_{0.67}N$-layers was 1 μm.

EXPLANATIONS TO EXAMPLES 2-5

The following expressions/terms are commonly used in metal cutting, and explained in the table below:

| | |
|---|---|
| $V_c$ (m/min): | cutting speed in meters per minute |
| $f_z$ (mm/tooth): | feed rate in millimeter per tooth |
| z: (number): | number of teeth in the cutter |
| $a_e$ (mm): | radial depth of cut in millimeter |
| $a_p$ (mm): | axial depth of cut in millimeter |
| D (mm): | cutter diameter in millimeter |

EXAMPLE 2

Inserts from example 1 with geometry R390-11T0308M-PM and with an ER of 20 μm were compared. The inserts were tested in shoulder milling of hardened steel.

| | |
|---|---|
| Work piece material: | Hardened steel, Sverker 21 (HRc = 59) |
| Vc = | 60 m/min, |
| fz = | 0.12 mm/tooth |
| ae = | 1 mm |
| ap = | 4 mm |
| z = | 1 |
| D = | 32 mm |
| Cooling: | Dry conditions |

Tool life criterion was flank wear more than 0.2 mm, fritting more than 0.3 mm or slice fracture or edge destruction of any edge.

Insert A (prior art) was suffering from edge-line spalling and the coating thickness in the edge was only 2-2.5 μm, about half the flank side thickness some distance from the edge. Insert B (invention) did not suffer from edge-line spalling, and the coating thickness in the edge was here slightly more than the flank side thickness, or 6.5 μm.

Insert A (prior art) lasted 19 min in this operation, whereas insert B (invention) lasted 25 min. Decisive difference in wear type for increasing the tool life was less fritting.

EXAMPLE 3

Inserts A (prior art) and B (invention) from Example 1 with geometry R290-12T308M-KM and an uncoated edge radius of 30 μm were tested and compared in a milling operation.

| | |
|---|---|
| Work piece material: | CGI (compacted graphite iron) Sintercast |
| Vc = | 300 m/min |
| fz = | 0.15 mm/tooth |
| ae = | 50 mm |
| ap = | 3 mm |
| z = | 3 |
| D = | 63 mm |
| Notes: | Dry conditions |

Tool life criterion was flank wear more than 0.3 mm as average over 3 edges, fritting more than 0.4 mm, slice fracture or edge destruction of any edge.

Insert A (prior art) lasted 9 minutes in this application, whereas insert B (invention) lasted 19 minutes. Decisive difference in wear type for increasing the tool life was less fritting.

EXAMPLE 4

Inserts A (prior art) and B (invention) from example 1 with geometry R390-11T0308M-PM, ER=35 μm were tested in a milling operation during the following cutting conditions:

| | |
|---|---|
| Work piece material: | low alloy steel, SS2244 |
| Vc = | 150, 200 m/min |
| fz = | 0.15 mm/tooth |
| ae = | 25 mm |
| ap = | 3 mm |
| z = | 2 |
| D = | 25 mm |
| Coolant: | emulsion |

Tool life criterion was flank wear more than 0.2 mm or fritting more than 0.3 mm.

Insert A (prior art) lasted 30 minutes in this application, whereas insert B (invention) lasted 39 minutes.

At an increased Vc=200 m/min, insert A (prior art) lasted 20 min whereas insert B (invention) lasted for 37 min.

Decisive difference in wear type for increasing the tool life was less chipping in the edge line combined with less flank wear. Interestingly, insert B (invention) showed a slow and steady increase in wear whereas insert A (prior art) suffered from a more catastrophic failure.

EXAMPLE 5

Inserts A (prior art) and B (invention) from example 1 with geometry R390-11T0308M-PM, ER=35 μm were tested in a milling operation during the following cutting conditions:

| | |
|---|---|
| Work piece material: | Hardened steel, Sverker 21 HRc = 59 |
| Vc = | 40 m/min |
| fz = | 0.12 mm/tooth |
| ae = | 2 mm |

-continued

| | |
|---|---|
| ap = | 4 mm |
| z = | 1 |
| D = | 32 mm |
| Note: | Coolant: emulsion |

Tool life criterion was flank wear more than 0.2 mm or fritting more than 0.3 mm.

Insert A (prior art) lasted 10.5 minutes in this application, whereas insert B (invention) lasted 14 minutes.

Decisive difference in wear type for increasing the tool life was less chipping of the edge line combined with less flank wear.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A coated cutting tool comprising a substrate of cemented carbide, cermets, ceramics, cubic boron-nitride or high speed steel provided with a coating comprising a metallic interlayer placed in-between at least two non-metallic, functional layers or layer systems where:

the metallic interlayer comprises at least about 60 at % metal elements chosen from one or more of Ti, Mo, Al, Cr, V, Y, Nb, W, Ta and Zr;

where the at least two non-metallic, functional layers or layer systems is one or more of nitrides, oxides, borides, carbides, or combinations thereof;

the thickness of the at least two non-metallic functional layer or layer systems being from about 3 to about 200 times the thickness of the metallic interlayer and the number of non-metallic, functional layers or layer systems alternated with metallic interlayers is at least 3, and the total coating thickness is from about 0.5 to about 15 μm.

2. The coated cutting tool of claim 1 wherein the composition of the non-metallic, functional layers or layer systems is one or more of (Al,Ti)N, TiN, (Al,Cr)N, CrN, ZrN, Ti(B,N), $TiB_2$, (Zr,Al)N, (Ti,X)N, and oxides of one or more of Al, Zr and Cr, where X can be one or more of Si, Ta, V, Y, Cr, Nb and Zr.

3. The coated cutting tool of claim 1 wherein the metallic interlayer is a pure metal layer where the metal(s) are chosen from Ti, Mo, Al, Cr, V, Y, Nb, W, Ta or Zr or any mixture thereof.

4. The coated cutting tool of claim 1 wherein the thickness of the coating is at least about 10% but less than about 45% of the uncoated edge radius, ER of the substrate.

5. The coated cutting tool of claim 1 wherein the thickness of the metallic interlayer is from about 5 nm to about 500 nm.

6. A method of making a coated cutting tool having a substrate of cemented carbide, cermets, ceramics, cubic boron-nitride or high speed steel, and coating said substrate with a coating process comprising the steps of:

a). deposition of at least one non-metallic, functional layer or layer system, comprising nitrides, oxides, borides, carbides, or combinations thereof, b). deposition of at least one metallic interlayer, comprising at least about 60 at % metal elements chosen from one or more of Ti, Mo, Al, Cr, V, Y, Nb, W, Ta and Zr, c). onto said metallic interlayer, depositing of at least one non-metallic, functional layer or layer system comprising nitrides, oxides, borides, carbides, or combinations thereof, wherein steps b) and c), are repeated at least 1 time, the thickness of the non-metallic functional layer or layer systems is from about 3 to about 200 times the thickness of the metallic interlayer and the number of non-metallic, functional layers or layer systems alternated with metallic interlayers is at least 3, and the total coating thickness is from about 0.5 to about 15 μm.

7. The method of claim 6 wherein the coating is deposited with a PVD technique.

8. The method of claim 6 wherein the thickness of the deposited coating is at least about 10%, but less than about 45%, of the uncoated edge radius, ER of the substrate.

9. The method of claim 6 wherein the deposited, non-metallic layers or layer systems, is one or more of (Al,Ti)N, TiN, (Al,Cr)N, CrN, ZrN, Ti(B,N), $TiB_2$, (Zr,Al)N, (Ti,X)N, and oxides of one or more of Al, Zr and Cr, where X can be one or more of Si, Ta, V, Y, Cr, Nb and Zr.

10. The method of claim 6 wherein the deposited metallic interlayer is a pure metal layer where the metal(s) are chosen from Ti, Mo, Al, Cr, V, Y, Nb, W, Ta or Zr, any mixture thereof.

11. The method of claim 6 wherein the thickness of the metallic interlayer is from about 5 nm to about 500 nm.

* * * * *